US007493923B2

(12) United States Patent
Barrett et al.

(10) Patent No.: US 7,493,923 B2
(45) Date of Patent: Feb. 24, 2009

(54) DOUBLE LAYER PAPERMAKERS FABRIC WITH POCKETS FOR BULK ENHANCEMENT

(75) Inventors: Rex Barrett, Neenah, WI (US); Rae Patel, Appleton, WI (US)

(73) Assignee: AstenJohnson, Inc., Charleston, SC (US)

( * ) Notice: Subject to any disclaimer, the term of this patent is extended or adjusted under 35 U.S.C. 154(b) by 52 days.

(21) Appl. No.: 11/684,843

(22) Filed: Mar. 12, 2007

(65) Prior Publication Data

US 2007/0209770 A1 Sep. 13, 2007

Related U.S. Application Data

(60) Provisional application No. 60/781,221, filed on Mar. 10, 2006.

(51) Int. Cl.
*D21F 7/08* (2006.01)
*D03D 3/04* (2006.01)
*D03D 25/00* (2006.01)

(52) U.S. Cl. ..... 139/383 A; 139/383 R; 162/348; 162/358.1; 162/358.2

(58) Field of Classification Search ..... 139/383 R, 139/383 A, 383 AA, 408, 411, 412, 413, 139/414; 162/348, 358.1, 358.2, 900, 902, 162/903, 904
See application file for complete search history.

(56) References Cited

U.S. PATENT DOCUMENTS 4,438,788 A 3/1984 Harwood (Continued)

FOREIGN PATENT DOCUMENTS

WO 2005035867 4/2005

(Continued)

*Primary Examiner*—Bobby H Muromoto, Jr.
(74) *Attorney, Agent, or Firm*—Volpe and Koenig, P.C.

(57) ABSTRACT

A double layer papermakers' fabric that is particularly suitable for forming or through-air drying (TAD) of high bulk tissue and towel product is provided. The fabric includes a single warp yarn system interwoven with three weft yarn systems such that: a first of the weft yarn systems is located on the paper side (PS) surface of the fabric; a second of the weft yarn systems is located on the machine side (MS) surface of the fabric; and the third weft yarn system is located intermediate between the first and second weft yarn systems. The yarns of the first and second weft yarn systems are interwoven with the warp yarn system such that they are vertically stacked with respect to one another in the fabric. The yarns of the third weft yarn system are interwoven so as to be located in a central plane of the fabric that is intermediate of the first and second weft yarn systems, and each yarn of the third yarn system is located in between the vertically stacked pairs of weft yarns of the first and second weft yarn systems. The warp and weft yarn systems are interwoven according to an asymmetric design which provides generally rectangular pockets on each of the PS and MS of the fabric with the yarns of the third weft yarn system forming the "bottom" of each pocket. There may be from about 50 to 750 pockets per sq. in. of fabric, each ranging in depth from about 0.1 mm to about 1.0 mm in depth; these pockets impart unevenness to the fabric surface which assists in creating bulk in the sheet formed or conveyed thereon. The fabrics of the invention also offer low sheet contact area, typically less than 30% of the total fabric surface, and generally in the range of from 15% to about 20%. The fabrics are also highly air permeable to ensure good air flow and drainage of the sheet.

23 Claims, 8 Drawing Sheets

U.S. PATENT DOCUMENTS 4,621,663 A * 11/1986 Malmendier ..... 139/383 A
4,636,426 A 1/1987 Fleischer
4,749,007 A * 6/1988 Malmendier ..... 139/383 A
4,824,525 A * 4/1989 Penven ..... 162/358.2
4,892,781 A * 1/1990 Penven ..... 442/189
5,103,874 A * 4/1992 Lee ..... 139/383 A
5,151,316 A 9/1992 Durkin et al.
5,211,815 A * 5/1993 Ramasubramanian et al. ..... 162/348
5,228,482 A * 7/1993 Fleischer ..... 139/383 A
5,240,763 A * 8/1993 Wagner et al. ..... 428/222
5,456,293 A * 10/1995 Ostermayer et al. ..... 139/383 A
5,520,225 A * 5/1996 Quigley et al. ..... 139/383 A
5,542,455 A * 8/1996 Ostermayer et al. ..... 139/383 A
5,597,450 A 1/1997 Baker et al.
5,806,569 A * 9/1998 Gulya et al. ..... 139/383 A
5,839,479 A * 11/1998 Gulya et al. ..... 139/383 A
5,853,547 A * 12/1998 Ahrens et al. ..... 162/348
6,334,467 B1 1/2002 Barrett et al.
6,649,026 B2 * 11/2003 Lamb ..... 162/348
6,673,202 B2 1/2004 Burazin et al.
6,902,652 B2 6/2005 Martin
2002/0088596 A1 * 7/2002 Lamb ..... 162/902
2004/0182466 A1 9/2004 Johnson et al.
2005/0067039 A1 * 3/2005 LaFond et al. ..... 139/383 A
2007/0028994 A1 2/2007 Kroll et al.
2007/0175534 A1 * 8/2007 Barrett et al. ..... 139/383 A

FOREIGN PATENT DOCUMENTS

WO 2006113818 10/2006

* cited by examiner

Figure 6

| | 1 | 2 | 3 | 4 | 5 | 6 | 7 | 8 | 9 | 10 |
|---|---|---|---|---|---|---|---|---|---|---|
| 1' | | 2 | | 4 | | | 7 | | 9 | |
| 2' | 1 | 2 | | 4 | 5 | 6 | 7 | | 9 | 10 |
| 3' | 1 | 2 | | 4 | | 6 | 7 | | 9 | |
| 4' | 1 | | | 4 | | 6 | | | 9 | |
| 5' | 1 | 2 | 3 | 4 | | 6 | 7 | 8 | 9 | |
| 6' | 1 | | 3 | 4 | | 6 | | 8 | 9 | |
| 7' | 1 | | 3 | | | 6 | | 8 | | |
| 8' | 1 | | 3 | 4 | 5 | 6 | | 8 | 9 | 10 |
| 9' | 1 | | 3 | | 5 | 6 | | 8 | | 10 |
| 10' | | | 3 | | 5 | | | 8 | | 10 |
| 11' | 1 | 2 | 3 | | 5 | 6 | 7 | 8 | | 10 |
| 12' | | 2 | 3 | | 5 | | 7 | 8 | | 10 |
| 13' | | 2 | | | 5 | | 7 | | | 10 |
| 14' | | 2 | 3 | 4 | 5 | | 7 | 8 | 9 | 10 |
| 15' | | 2 | | 4 | 5 | | 7 | | 9 | 10 |
| 16' | | 2 | | 4 | | | 7 | | 9 | |
| 17' | 1 | 2 | | 4 | 5 | 6 | 7 | | 9 | 10 |
| 18' | 1 | 2 | | 4 | | 6 | 7 | | 9 | |
| 19' | 1 | | | 4 | | 6 | | | 9 | |
| 20' | 1 | 2 | 3 | 4 | | 6 | 7 | 8 | 9 | |
| 21' | 1 | | 3 | 4 | | 6 | | 8 | 9 | |
| 22' | 1 | | 3 | | | 6 | | 8 | | |
| 23' | 1 | | 3 | 4 | 5 | 6 | | 8 | 9 | 10 |
| 24' | 1 | | 3 | | 5 | 6 | | 8 | | 10 |
| 25' | | | 3 | | 5 | | | 8 | | 10 |
| 26' | 1 | 2 | 3 | | 5 | 6 | 7 | 8 | | 10 |
| 27' | | 2 | 3 | | 5 | | 7 | 8 | | 10 |
| 28' | | 2 | | | 5 | | 7 | | | 10 |
| 29' | | 2 | 3 | 4 | 5 | | 7 | 8 | 9 | 10 |
| 30' | | 2 | | 4 | 5 | | 7 | | 9 | 10 |

51

DOUBLE LAYER PAPERMAKERS FABRIC WITH POCKETS FOR BULK ENHANCEMENT

CROSS-REFERENCE TO RELATED APPLICATIONS

This application claims the benefit of U.S. Provisional Application No. 60/781,221, filed Mar. 10, 2006, which is incorporated herein by reference as if fully set forth.

FIELD OF THE INVENTION

The invention relates to papermakers fabrics, and in particular to an improved through-air-drying (TAD) fabric for creating a sheet with enhanced bulk, typically for tissue and towel applications.

BACKGROUND

The majority of towel and issue products are presently manufactured according to one of either the conventional wet pressing (CWP) or through-air drying (TAD) processes. In the CWP process, water is removed from the nascent web by mechanical pressure and the resulting sheet is dry embossed. A disadvantage of this process is that it densifies the web, decreasing bulk and absorbency in the resultant sheet. The TAD process is frequently preferred for the manufacture of tissue and towel because it avoids the compressive forces of the dewatering step in the CWP method. In the TAD process, the wet web is formed by depositing a papermaking furnish onto a moving forming fabric where it is initially drained, and then transferring the resulting very wet web onto a TAD fabric, which is generally of a very open and permeable design. The TAD fabric is caused to travel around an open drum where the sheet is non-compressively dried by passing hot air through the web while it is held in intimate contact with the fabric. It is well known that fabrics having a three-dimensional (i.e. non-planar) paper side surface can introduce protuberances into the sheet which can, in turn, impart significantly increased bulk and absorbent capacity to the resulting paper product. The present invention is directed towards fabrics of this type.

Fabrics for use in the formation and through-air drying of tissue products to enhance the bulk of those products are well known. See for example WO 2005/035867 to Lafond et al. which discloses a multilayer tissue forming fabric having topographical height differences between at least two top weft yarns. US 2004/0182466 to Johnson et al. discloses a multilayer TAD fabric with two weft and one warp system in which the pattern causes the warp yarns to stand proud of the papermaking surface to impart bulk. U.S. Pat. No. 6,673,202 to Burazin et al. discloses patterning and bulk enhancement in a TAD fabric by applying a polymeric material onto a substrate fabric. U.S. Pat. Nos. 5,853,547 and 5,839,479 both to Wright et al. disclose a single layer TAD fabric woven according to a 7/3 broken twill design to provide open basket-like areas for high bulk and absorbency in the resulting paper product; in this fabric there are 4 small and 3 larger CD yarns under each PS float, the CD yarns having alternating large and small diameters.

U.S. Pat. No. 4,438,788 to Harwood discloses a papermakers fabric having surface floats on both the PS and MS for improved sheet contact area and improved abrasion resistance. The fabric also includes a plurality of stuffer pick receiving sheds defined by warp yarns of non-circular generally rectangular cross section. The amount of stuffer picks used in the fabric will depend on the air permeability desired.

A pin seam is created at the opposing fabric ends by symmetrically reweaving the warp yarns into the fabric to create the seaming loops. The fabric includes three layers of weft yarns interwoven with a single system of warp yarns to provide a smooth surface and high degree of contact with the paper sheet to increase drying efficiency. There is no disclosure of the use of this fabric to provide a PS which includes pockets or depressions to enhance the bulk of a paper sheet formed or conveyed thereon.

WO2006/113818 discloses a through air during fabric for producing tissue and related products. The fabric is a single layer fabric that includes pockets on both sides bounded by warp and weft yarns having extended floats. The yarns within the pockets are woven in a plain weave. Three different warp contours for the warp yarns are required, making the fabric more complex to weave and resulting in non-uniformities.

SUMMARY OF THE INVENTION

The invention concerns a double layer papermakers' fabric suitable for use in forming or through-air drying (TAD) of tissue or towel where it is important to impart a measure of bulk into the product being conveyed. The fabric is comprised of a single warp yarn system interwoven with three weft yarn systems such that a first of the weft yarn systems is located on the paper side (PS) surface of the fabric, a second of the weft yarn systems is located on the machine side (MS) surface of the fabric, and the third weft yarn system is located intermediate between the first and second weft yarn systems. The yarns of the first and second weft yarn systems are located in vertically stacked relationship with respect to one another in the fabric and are interwoven with the warp yarns according to an asymmetric design so as to form generally rectangular pockets on each of the PS and MS of the fabric. The yarns of the third weft yarn system are located in a central plane of the fabric, intermediate of the first and second weft yarn systems and in between vertically stacked pairs of weft yarns of the first and second weft yarn systems so as to form the "bottom" of each pocket. These pockets impart a surface roughness to the fabric which assists in creating bulk in the sheet formed or conveyed thereon, while still providing for a low sheet contact area and a high air permeability, which are beneficial in TAD applications.

Preferably, the fabric is woven according to a 5-shed asymmetric pattern, but other patterns are possible which embody the features of the invention and which can be woven in differing numbers of sheds.

Preferably, the contact area between the fabric and sheet is <30%; more preferably, the contact area is <25%, and most preferably is as low as from 15% to about 20%.

Additionally, it is preferred that the depth of each pocket, as measured from the paper side surface of the fabric to the surface of the weft yarn forming the bottom of the pocket, ranges from about 0.1 to about 1.0 mm.

It is further preferred that the number of pockets on the PS surface ranges from 50 to 750 pockets per sq. in. (8 pockets per sq cm to 116 pockets per sq cm), and more preferably are in the range of 60-150 pockets per sq. in. (9.3 to 23.2 pockets per sq cm)

Preferably, the PS pockets which are formed have at least three PS warp knuckles that define the corners of the pockets.

In another aspect of the invention, a majority of the pockets are "full" defined by alternate warp yarns, with an intermediate warp yarn that is beneath the pocket. Additionally, a lesser number of "half" pockets which are defined between adjacent warp yarns are provided. Preferably, at least ⅔ of the pockets on PS are full pockets.

In one preferred embodiment of the invention, the warp yarns are paired in the fabric, providing a greater number of full pockets, which is believed to be beneficial in imparting or enhancing bulk.

Additionally, in the preferred fabrics, the air permeability is in the range of 450 cubic feet per minute (cfm) (7,300 $m^3/m^2/hr$) to 1200 cfm (19,450 $m^3/m^2/hr$). The fabric mesh is from 30 to 70 warp yarns per inch (11.8 to 27.6 warp per cm) and 30 to 60 weft per inch (11.8 to 23.6 weft per cm) for TAD applications. Alternatively, the fabric mesh is from 70 warp or weft per inch (27.56 yarns per cm) to about 100 yarns per inch (39.37 yarns per cm) for tissue forming applications.

It is also possible in the fabrics according to the invention to incorporate warp yarns that are essentially rectangular in shape.

Additionally, the warp and weft yarns are preferably heat stabilized.

In one preferred configuration, the fabrics according to the invention have a caliper of about 0.035 in. to 0.065 in. (0.89 mm to 1.65 mm). In a second preferred configuration, the fabrics have a caliper of about 0.018 to 0.040 inches (0.46 mm to 1.02 mm)

In another aspect of the invention, the papermakers' fabric construction is particularly suited for use in a forming section of a papermaking machine, in particular in tissue applications, where it is desirable to impart bulk in the tissue sheet being formed. The construction of the fabric is similar to the TAD fabric, as discussed above, except that different yarn sizes are utilized for the warp and weft yarns, and the fabric permeability is preferably lower to provide for good sheet formation. The pockets trap and enhance the bulk of the sheet being formed, with the pocket formation of the present invention acting to enhance sheet release and prevent the fibers from becoming lodged or entangled in the fabric.

BRIEF DESCRIPTION OF THE DRAWINGS

The present invention will be explained in more detail in connection with the drawings in which presently preferred embodiments are shown.

FIG. 6 is the weave diagram of the fabric shown in the Figures.

DETAILED DESCRIPTION OF THE PREFERRED EMBODIMENTS

Figure 1:
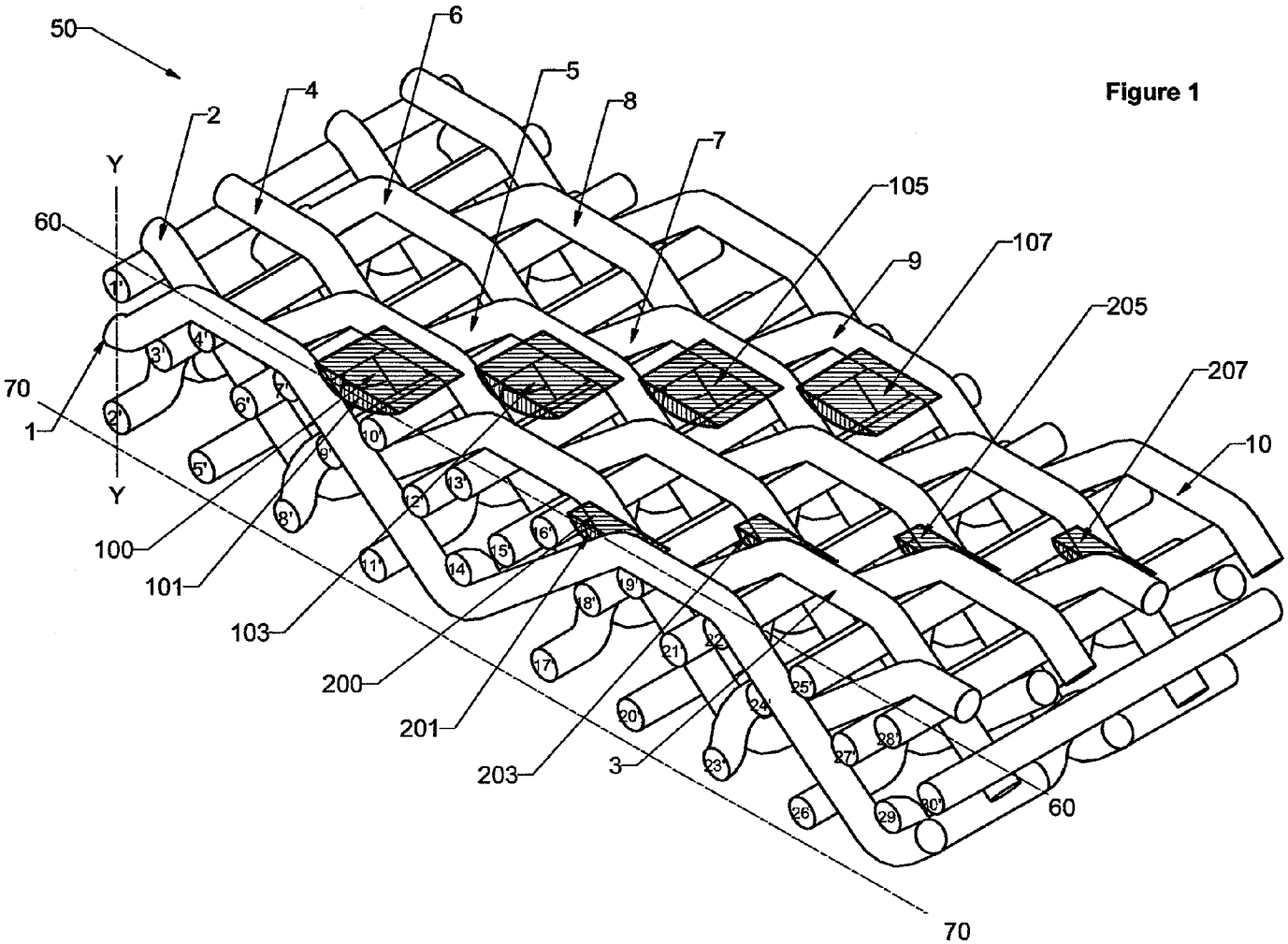
FIG. 1 is a perspective view of a fabric according to the invention, showing the pockets in the paper side surface.

Certain terminology is used in the following description for convenience only and is not considered limiting. Words such as "top" and "bottom" designate directions in the drawings to which reference is made. This terminology includes the words specifically noted above, derivatives thereof and words of similar import. "MD" refers to the machine direction that a papermaker's fabric travels in a papermaking machine. "CD" refers to the cross-machine direction. "PS" refers to the paper or sheet supporting surface of the fabric and "MS" refers to the machine contact side of the fabric. "Pocket" refers to a recess defined by crossing warp and weft yarns that is open toward the PS or MS of the fabric and bounded on its bottom by at least an intermediate layer weft yarn. A "full" pocket refers to a pocket that is defined by two boundary warp yarns that are spaced apart by another warp yarn, with the boundary warp yarns having at least three MS or PS warp knuckles that define corners of the pocket. A "half" pocket refers to a pocket that is defined by two boundary warp yarns that are adjacent to one another, with the boundary warp yarns having at least two MS or PS warp knuckles that define corners of the pocket. Additionally, the terms "a" and "one" are defined as including one or more of the referenced item unless specifically noted.

Figure 3:
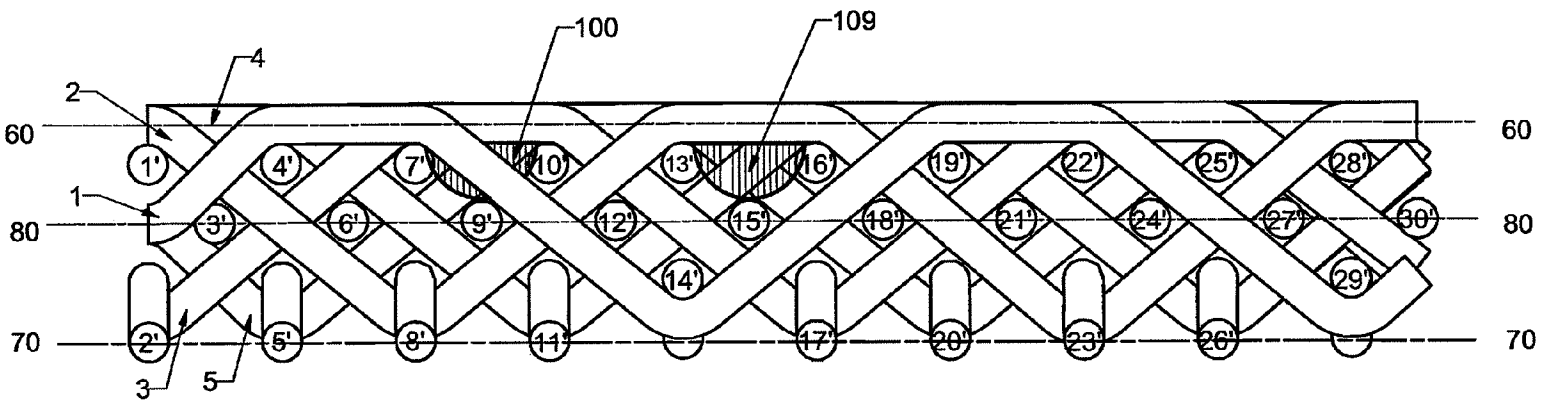
FIG. 3 is a cross-section taken along the plane III-III passing through the weft yarns along the warp yarns of the fabric shown in FIG. 1.
Figure 4:
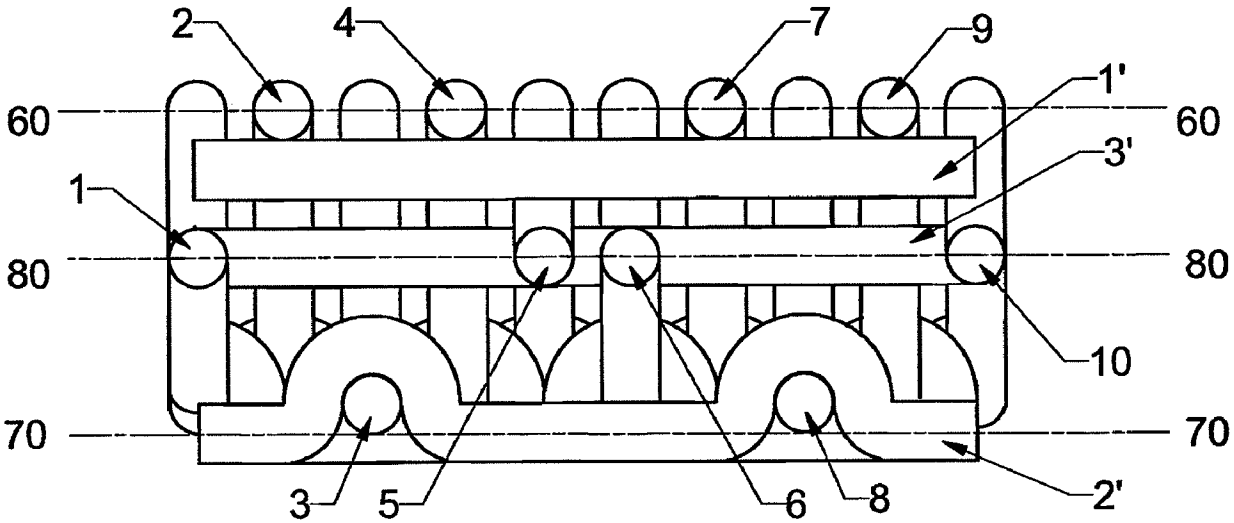
FIG. 4 is a cross section taken along the plane IV-IV passing through the warp yarns and along the weft yarns of the fabric shown in FIG. 1.

Referring to FIG. 1, a perspective view of a first embodiment of a fabric according to the invention is shown which is presently preferred and is generally designated as 50. In FIG. 1, the warp yarns are numbered from 1 to 10, and the weft yarns are numbered from 1' to 30'. Weft yarns of the first weft yarn system are numbered 1', 4', 7', 10', 13', 16', 19', 22', 25' and 28' and are interwoven with the warp yarns 1 through 10 to form a first generally planar surface 60 of the fabric 50 which, when in use, generally contacts a paper sheet being carried by the fabric and is thus the PS. Weft yarns of the second weft yarn system are numbered 2', 5', 8', 11', 14', 17', 20', 23', 26' and 29' and are also interwoven with the warp yarns 1 through 10 to form a second generally planar surface 70 of the fabric 50 which, when in use, generally contacts the supporting rolls and drive rolls and is thus the MS of the fabric. Weft yarns of the third weft yarn system are numbered 3', 6', 9', 12', 15', 18', 21', 24', 27' and 30' and are interwoven with the warp yarns 1-10 so as to be located generally in a centre plane 80 in the fabric 50, as indicated in FIGS. 3 and 4, which is located intermediate of first planar surface 60 and second planar surface 70.

In the illustrated embodiment, two repeats of the fabric weave pattern are shown, in each of the machine and cross machine directions. The basic repeat unit of the weave pattern of the fabric 50 is a 5×15 pattern, meaning there are 5 warp yarns and 15 weft yarns in one repeat. In the fabric 50, warp 1-5 are interwoven with weft 1' through 15' to form the basic 5 shed repeat unit. The weave pattern of the fabric illustrated in FIGS. 1-5 is shown in FIG. 6.

In the fabrics of the invention, the warp yarns 1, 2, 3 through 10 are interwoven with the weft yarns 1', 2', 3', 4', 5', . . . 30' according to a pattern which provides for pockets designated 100, 101, 103, 105, 107, 200, 201, 203, 205, 207 in the first surface 60 of the fabric 50, which surface may be used to receive the paper sheet. In the first embodiment of the invention, two different types of pockets are formed. This includes full pockets, designated generally as 100, and including representative full pockets 101, 103, 105, 107 shown in FIG. 1, formed on the PS of the fabric 50. Half pockets, generally designated as 200, and including representative half pockets 201. 203, 205, 207 shown in FIG. 1 are also formed on the PS.

Figure 2:
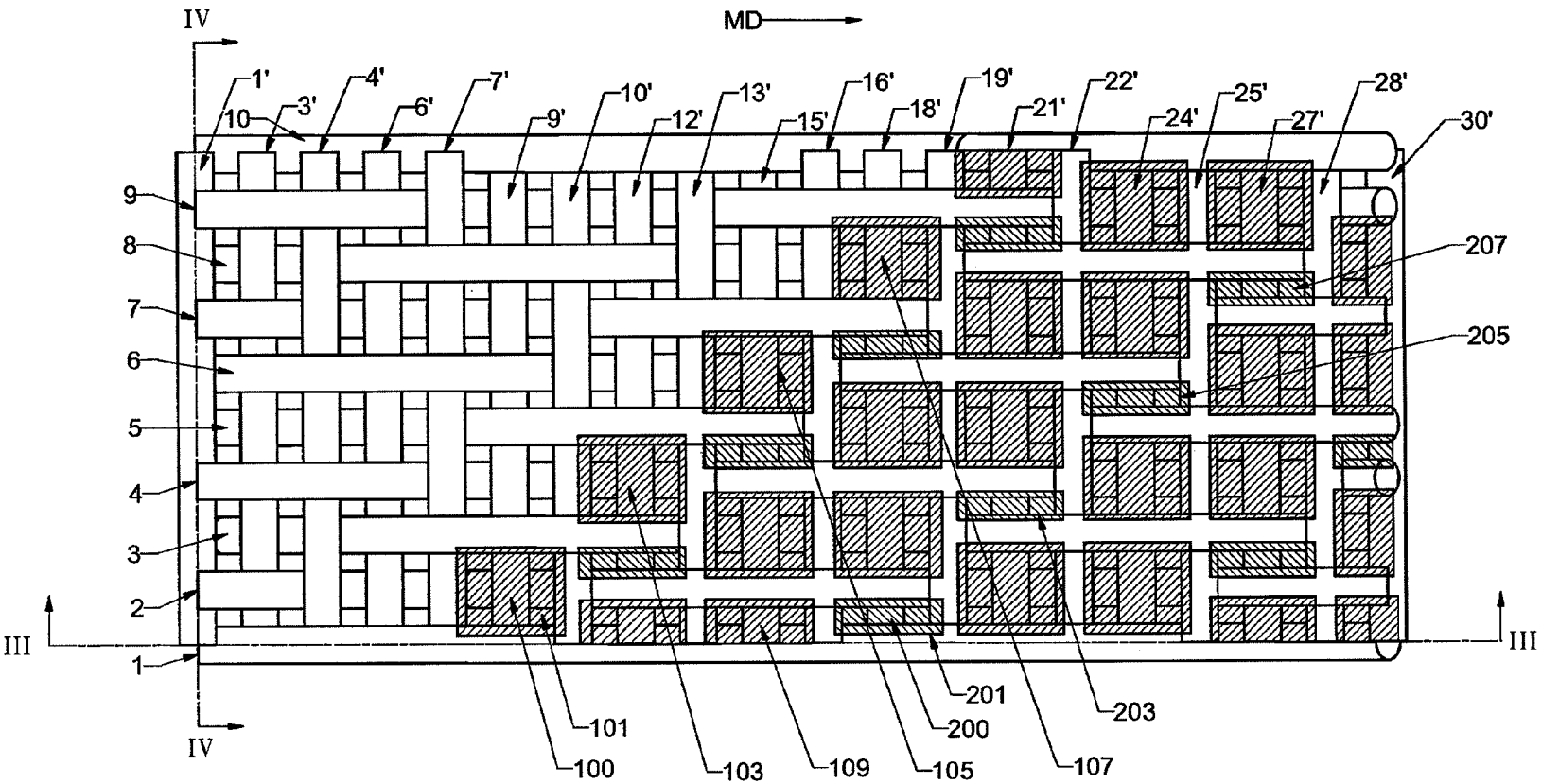
FIG. 2 is an orthographic perspective of a first surface of the fabric shown in FIG. 1.

As shown most clearly in FIG. 2, the full pockets 100 appear in surface locations between certain next adjacent portions of the warp yarns 1-10, and include three PS warp knuckles that define the corners in conjunction with first or top layer weft yarns 1', 4', 7', 10', 13', 16', 19', 22', 25' and 28'. The half pockets 200 are located in the weave between certain adjacent portions of the warp yarns 1-10, as shown, and include two PS warp knuckles that define corners in conjunction with first or top layer weft yarns 1', 4', 7', 10', 13', 16', 19', 22', 25' and 28'. The weft yarns 3', 9', 12', 15', 18', 21', 24', 27', 30' of the intermediate or center layer 80 define the bottom of the full pockets 100 and half pockets 200. For example, and as discussed above in relation to FIG. 1, full pocket 101 is bounded on the surface 60 by warp yarns 1 and 3, weft yarns 7' and 10', and the bottom of the pocket is formed by weft 9'. Similarly, half pocket 201 is bounded by warp yarns 1 and 2, weft 16' and 19' and the bottom of pocket 201 is provided by weft 18' which is located in the center plane 80 of the fabric 50. The depth of the pockets is approximately equal to the diameter of the warp and weft yarns forming the boundaries of the pocket which, depending on the chosen yarn sizes, can range from about 0.0004 in. to about 0.039 in. (0.10 mm to about 1.00 mm).

According to the invention, it is preferred to have a majority of full pockets 100 for bulk enhancement during use of the fabric 50 in a TAD application. In the first preferred embodiment, approximately ⅔ of the PS pockets are full pockets 100.

Based on this arrangement, the fabric 50 has a PS contact area of less than 30%, and more preferably in the range of 15-20%. This is predominantly created by warp floats, as can be seen most clearly in FIG. 2.

The depth of the pockets is approximately equal to the diameter of the warp yarns, but varies depending on the specific location and base the crimp of the yarns.

FIG. 3 illustrates a cross section of one repeat of the fabric shown in FIG. 1 taken along the line 3-3 parallel to the warp yarns. From FIG. 3, it can be seen that the weft yarns of the first set of weft yarns, i.e. 1', 4', 7', 10', 13', 16', 19', 22', 25' and 28', are vertically stacked over the weft yarns of the second set of weft yarns, i.e. 2', 5', 8', 11', 14', 17', 20', 23', 26' and 29'. It can also be seen that the weft yarns of the third set of weft yarns, i.e. 3', 6', 9', 12', 15', 18', 21', 24', 27' and 30' are interwoven with the warp yarns 1-10 so as to be located in a center plane 80 of the fabric 50, which plane is located intermediate of the first fabric surface 60 and the second fabric surface 70. Each of the weft yarns 3', 6', 9', 12', 15', 18', 21', 24', 27' and 30' of the third set of weft yarns forms the bottom of a pocket whose opening is formed on the first surface 60 of the fabric 50. Full pocket 109 is typical and is shown in cross-section; it is bounded by weft yarns 13' and 16' on the first surface, by warp 2 and an adjacent warp 10 (not shown), and on the bottom by weft 15' located in the center plane 80 of the fabric 50. Depending on the sizes of the warp and weft yarns used to weave the fabric 50, the pockets 100, 200 may have a depth of from about 0.1 mm to about 1.0 mm and there may be from 50 to 750 pockets per sq. in. (8 to 116 pockets per sq cm), and more preferably there are in the range of 60-150 pockets per sq. in. (9.3 to 23.2 pockets per sq cm).

Preferably, the weft yarns 2', 5', 8', 11', 14', 17', 20', 23', 26' and 29' of the second set of weft yarns are woven so that they extend below the MS warp knuckles, as shown. This provides for increased life of the fabric 50, as the weft yarns act as the main wear surface.

FIG. 4 is an illustration of a cross-section of a fabric of the invention taken parallel to the weft yarns along line 4-4. From this Figure, it can be seen that the weft yarn 3' is located intermediate in the fabric between weft yarns 1' and 2'. Additionally, the position of the weft yarn 2' of the second set of weft yarns is clearly illustrated extending below the MS warp knuckles, which protects the warp yarns 1-10 from wear on the machine side in use.

Figure 5:
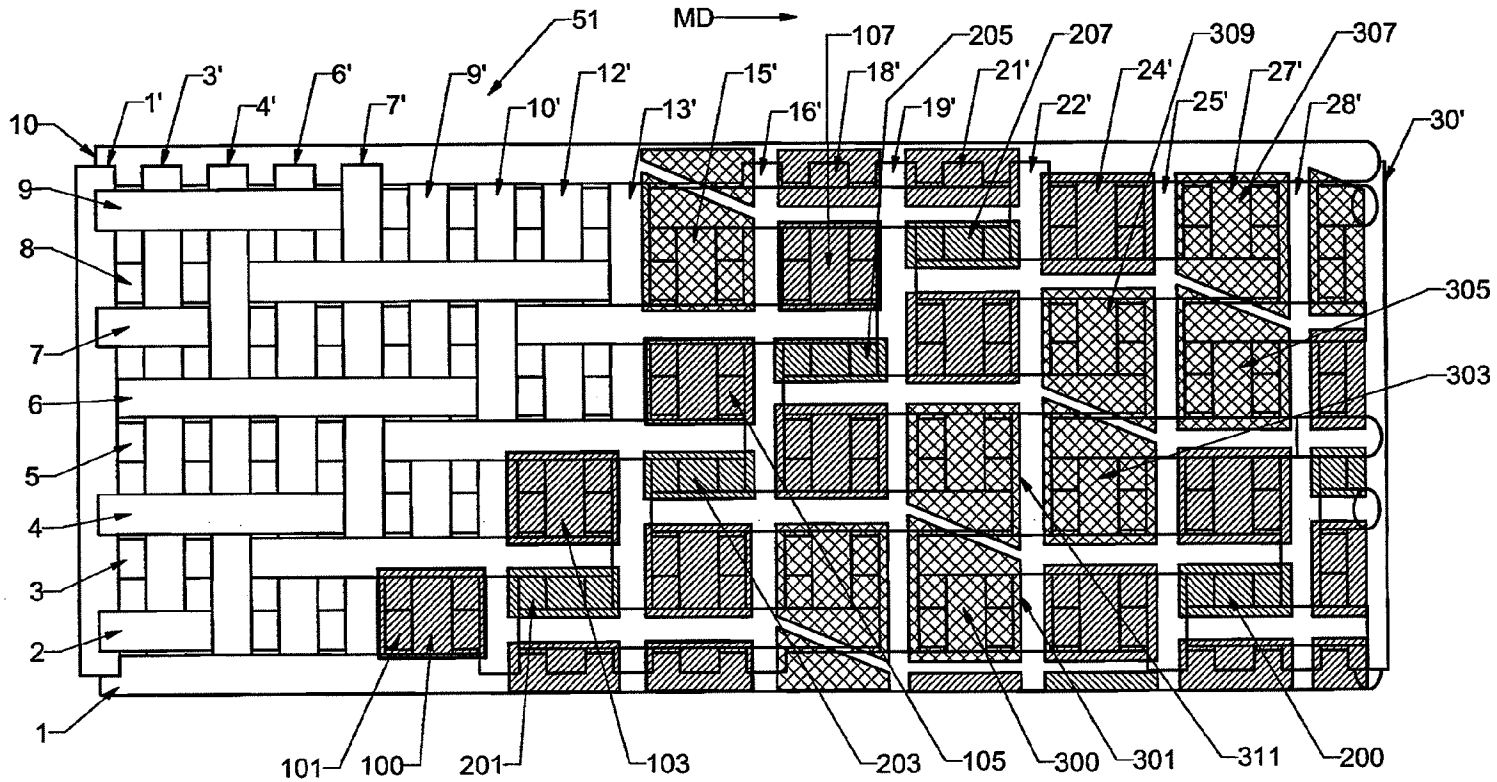
FIG. 5 is an orthographic perspective of second embodiment of a fabric according to the invention.

FIG. 5 shows an alternate embodiment of the fabric 51 shown in FIGS. 1 through 4. The fabric 51 is similar to that shown in the orthographic projection of FIG. 2 except that in the illustrated embodiment, the warp yarns 1-10 have been woven in the loom two per dent so that they are paired in the resulting fabric. The term "dent" as would be known to those of skill in the art of weaving refers to the opening in the reed through which the warp yarns pass. In FIG. 5, warp yarns 1 and 2 have been passed together through the same reed dent following the heddles, as have warp yarns 3 and 4, 5 and 6, 7 and 8, and 9 and 10. This has the effect of locating these paired warp yarns in the cloth in closer proximity to one another than with a warp yarn such as warp yarn 3 that is not passed through the same heddle as warp 1 and 2. This effect may provide benefit in certain manufacturing situations where the objective is to increase sheet bulk and surface topography.

Still with reference to FIG. 5, a distinct difference of the fabric 51 from the prior embodiment 50, is that the number of half pockets 200 has been effectively reduced through the creation of a second type of "full" pocket 300, which is has four PS warp knuckles defining the corners of the pocket. This is the result of the paired warp yarns 1, 2; 3, 4; 5, 6; 7, 8; 9, 10 in effect defining a single side of a pocket 300. For example the full pocket 301 has two PS warp knuckles defined by the float in warp yarn 1 over weft yarns 19' and 22'. A third corner is defined by the PS warp knuckle of warp yarn 3 over weft yarn 22', and the fourth corner is defined by the PS warp knuckle of warp yarn 4 over the weft yarn 19'. A number of this type of full pockets 300 have been designated in the Figure as 301, 303, 305, 307, 309, 31. While they have been illustrated with a trapezoidal shape for the sake of the drawings, those skilled in the art will recognize that this is used for illustrative purposes only, and the actual shape can vary based on the yarn type and weave. This arrangement of using paired warp yarns creates more full pockets 100, 300 which is believed to be beneficial in enhancing bulk in the paper being carried by the fabric.

Figure 7:
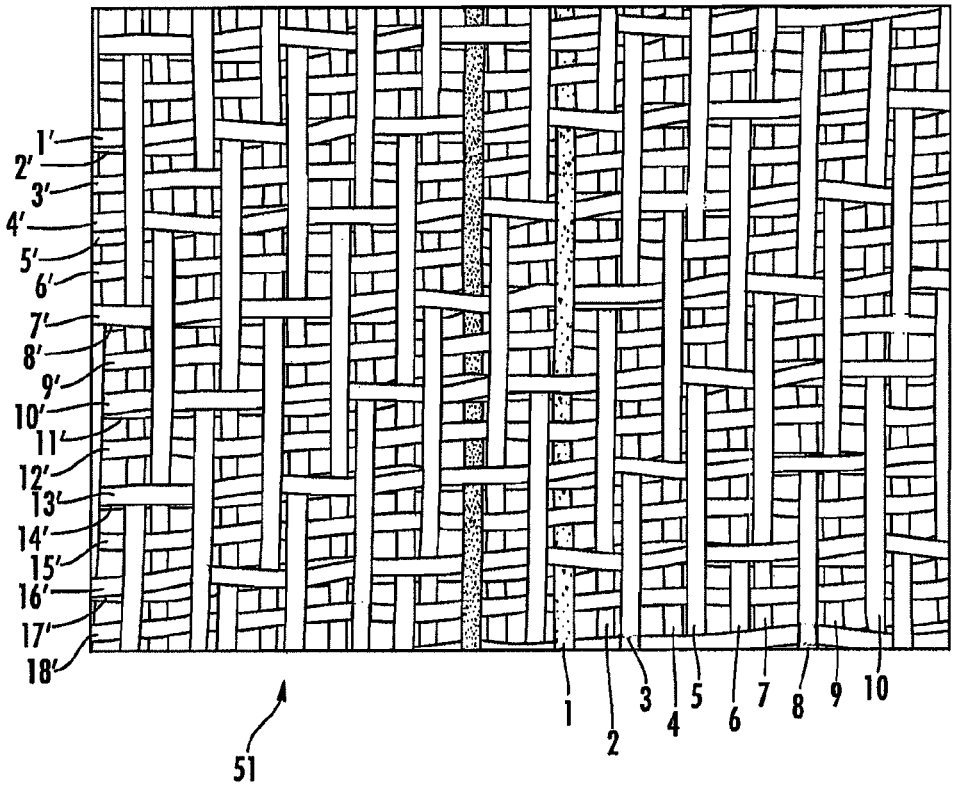
FIG. 7 is a photograph of a first surface of a fabric woven according to the weave design shown in FIG. 6, corresponding to the illustration of FIG. 5.
Figure 8:
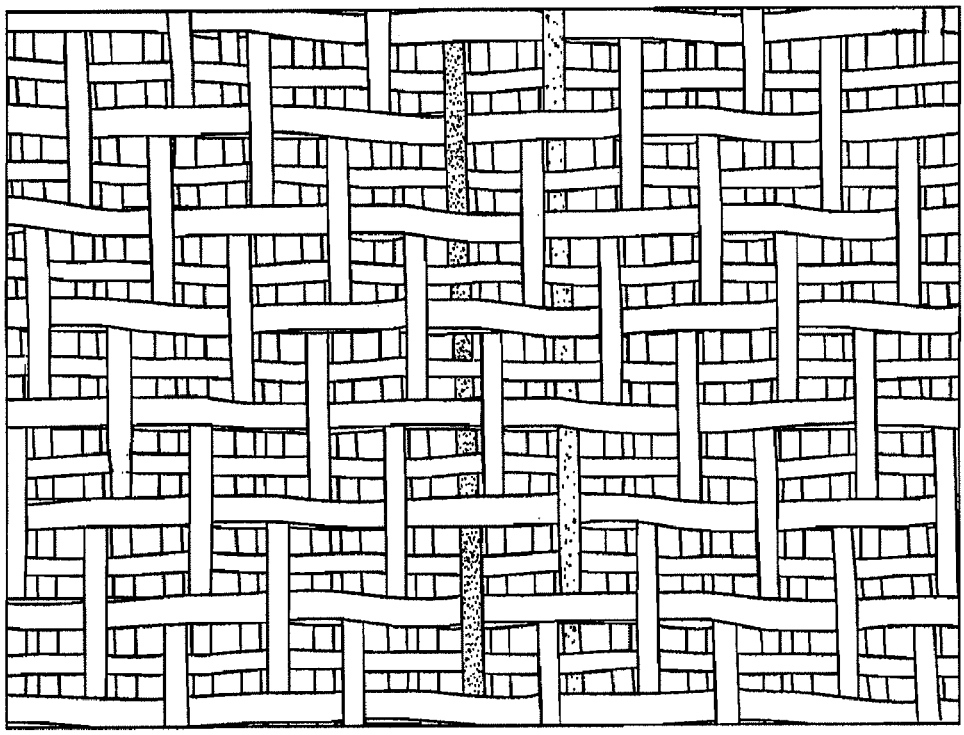
FIG. 8 is a photograph of a second surface of a fabric woven according the weave design shown in FIG. 6 and is the surface of the fabric located opposite the surface shown in FIG. 7 and FIG. 5.

FIGS. 7 and 8 show an actual fabric 51 in accordance with FIG. 5, which has been woven with the paired warp yarns 1-10. In FIG. 7, a first surface of a fabric 51 woven according to the weave diagram shown in FIG. 6 is shown, which is generally used as the PS. The warp yarns 1-10 have been woven two per dent, as discussed in relation to FIG. 5. Here, the actual formation of the full pockets 100, 300, and half pockets 200 can be seen, with the weft yarns of the third weft yarn system 3', 6', 9', 12', 15', 18', 21', 24', 27' and 30' in the centre plane 80 defining the bottoms of the pockets. FIG. 8 shows the second side of the fabric 51, which will generally be on the MS.

FIG. 6 is a conventional weave diagram of a fabric of the invention. In this diagram, the warp yarns are numbered 1-10 across the top of the diagram and the weft yarns are numbered 1' through 30' along the left side of the diagram. As is conventional in these diagrams, a black square represents a location in the pattern where the warp yarn passes over a weft yarn, and a white square represents a location in the pattern where a warp yarn passes under a weft yarn. For example, as shown in FIG. 5, warp 1 passes under weft 1', over weft 2'-9', under weft 10', over weft 11', under weft 12'-16', over weft 17'-24', under weft 25', over weft 26' and under weft 27'-30'. Those of skill in the art will readily recognize that the unit pattern repeat is defined by the warp yarns 1-5 and weft yarns 1' to 15', however, for ease of understanding, two repeats in each of the warp and weft directions are shown in FIGS. 5 and 6.

The fabrics 50, 51 of this invention are intended for through-air dryer (TAD) applications where they must convey a low basis weight sheet through the TAD dryer. The fabrics will generally be woven using round MD yarns having a diameter of about 0.25 mm to about 0.40 mm and round weft yarns whose diameters are in the range of from about 0.25 mm to about 0.50 mm; however, it will be understood that yarns having other cross-sectional profiles such as rectangular, oval and otherwise would also be suitable for use as either the warp or weft.

In certain applications it will be advantageous to weave the fabrics of the invention using smaller yarns, such as those having diameters in the range of from about 0.11 mm-0.17 mm. Those of skill in the art will realize that the use of larger yarns in the CD of the machine side surface of the fabrics if this invention will assist in increasing fabric wear life and longevity. The yarns will normally be monofilaments comprised of polyethylene terephthalate (PET) which may be heat stabilized to better withstand the high temperatures to which the fabric will be exposed when used in a TAD environment. However, other materials, in particular polyethylene napthalate (PEN) may also be suitable for certain applications.

The yarns are interwoven to provide a fabric having about 30 to 70 warp yarns per inch (11.8 to 27.6 warp per cm) and from about 30 to 60 weft per inch (11.8 to 23.6 weft per cm) for TAD applications. Other applications, such as the formation of tissue, may require higher yarn counts in the vicinity of from about 70 warp or weft per inch (27.56 yarns per cm) to about 100 yarns per inch (39.37 yarns per cm). The apparent number of weft yarns in the first surface of the fabric, which will normally be in contact with the paper sheet when in use, will be the sum of the number of weft yarns at that surface, plus those underneath and in the intermediate layer. The apparent number of weft yarns in the second surface of the fabric, which when in use will normally be in contact with the fabric bearing surfaces of the paper machine, will be half that of the first surface. For example, if the number of weft in the first surface is 16 (eight from the first surface, plus eight from the intermediate surface), then the number of weft in the second surface will be half of 16, or eight. The higher apparent number of weft yarns in the PS of the fabrics of this invention will provide increased surface contact area and reduce the need to surface the fabric (for example by means of an abrasive). This will also increase seam strength, while reducing the width of the woven seam area and eliminating the need to glue the warp yarn ends to help hold them in place.

The fabrics of this invention typically have a caliper (thickness) that is in the range of from about 0.018 inches to about 0.065 inches (0.452 mm to about 1.65 mm) and air permeability which can range from as low as about 450 cubic feet per minute (cfm) (7,300 $m^3/m^2/hr$) to as high as 1200 cfm (19,450 $m^3/m^2/hr$) or more. For TAD applications, preferably the air permeability is in the upper range. While the described preferred embodiments of the fabric 50, 51 have only been woven in a 5 shed pattern, those skilled in the art will recognize that the invention can be applied to other types of weaves.

Additionally, as shown most clearly by FIG. 8, the design according to the invention creates pockets in both the PS and MS surfaces of the fabric 50, 51. Accordingly, either side of the fabric theoretically could be used as the PS. However running the fabric in an inverted configuration changes the design from generally MD oriented to generally CD oriented meaning that the sheet will be exposed to differing topographies depending on which side of the fabric is "up". The pockets on both surfaces are a result of the weave and provide the benefits of the invention with a CPP (center plane pocket) providing a method to retain fiber, which is believed to allow the sheet to dry more uniformly in TAD applications, and which create an improvement in the tissue/towel products when used as a forming fabric.

The fabric 50, 51 may be treated by abrasive surfacing after weaving and heatsetting depending on the application in which it will be used. This increases the surface area in contact with the sheet. Also depending on the intended end use of the fabric, the seam may require reinforcement such as by gluing so as to increase fabric tensile strength.

While the preferred embodiments of the invention have been described in detail, the invention is not limited to the specific embodiments described above, which should be considered as merely exemplary. Further modifications and extensions of the present invention may be developed, and all such modifications are deemed to be within the scope of the present invention as defined by the appended claims.

The invention claimed is:

1. A double layer papermakers' fabric, comprising a system of warp yarns and first, second and third systems of weft yarns, interwoven according to an asymmetric weave pattern to provide a planar paper side surface, a planar machine side surface and a center plane located intermediate of the planar paper and machine side surfaces, such that:

a. the first system of weft yarns is interwoven with the system of warp yarns to provide the paper side surface of the fabric;

b. the second system of weft yarns is interwoven with the system of warp yarns to provide the machine side surface of the fabric;

c. the third system of weft yarns is interwoven with the system of warp yarns to provide the center plane of the fabric;

d. the system of warp yarns is interwoven with the first, second and third weft yarn systems according to an asymmetric weave pattern such that it passes from the paper to the machine side surface of the fabric in each repeat of the overall fabric weave pattern, wherein:

(i) the first system of weft yarns is interwoven with the system of warp yarns so as to form pockets on the paper side surface;

(ii) the second system of weft yarns is interwoven with the system of warp yarns so as to form pockets on the machine side surface;

(iii) a weft yarn from the third system of weft yarns is located at the bottom of each pocket; and (iv) the number of pockets on the PS surface ranges from 50 to 750 pockets per sq. in. (8 to 116 pockets per sq cm).

2. Fabric according to claim 1, wherein the PS sheet contact area is less than about 30%.

3. Fabric according to claim 1, wherein a depth of each pocket, as measured from a paper side surface of the fabric to a surface of the weft yarn forming the bottom of the pocket, ranges from 0.1 to 1.0 mm.

4. Fabric according to claim 1, wherein a number of weft yarns in each of the first, second and third systems of weft yarns is equal.

5. Fabric according to claim 1, wherein the fabric has a 5 shed weave pattern.

6. Fabric according to claim 1, wherein an air permeability of the fabric is from about 450 cubic feet per minute (cfm) (7,300 $m^3/m^2/hr$) to 1200 cfm (19,450 $m^3/m^2/hr$).

7. Fabric according to claim 1, wherein the mesh is from 30 to 70 warp yarns per inch (11.8 to 27.6 warp per cm) and 30 to 60 weft per inch (11.8 to 23.6 weft per cm).

8. Fabric according to claim 1, wherein the mesh is from 70 warp or weft per inch (27.56 yarns per cm) to about 100 yarns per inch (39.37 yarns per cm).

9. Fabric according to claim 8, wherein the number of pockets per sq in is greater than about 50 (7.75 pockets per sq cm).

10. Fabric according to claim 8, wherein the number of pockets is between 60-150 pockets per sq. in. (9.3 to 23.2 pockets per sq cm).

11. Fabric according to claim 1, wherein the warp yarns are comprised of polyethylene naphthalate (PEN).

12. Fabric according to claim 1, wherein the warp yarns are generally rectangular in shape.

13. Fabric according to claim 1, wherein the warp and weft yarns are heat stabilized.

14. Fabric according to claim 1, wherein the caliper is from 0.035 to 0.065 inches (0.138 mm to 0.256 mm).

15. Fabric according to claim 1, wherein the caliper is from 0.018 to 0.040 inches (0.07 mm to 0.0157 mm).

16. Fabric according to claim 1, wherein the fabric comprises a forming fabric.

17. Fabric according to claim 1, wherein the fabric comprises a TAD fabric.

18. Fabric according to claim 1, wherein the warp yarns are grouped in pairs.

19. Fabric according to claim 1, wherein a surface contact area of the fabric is from 15% to 20%.

20. Fabric according to claim 1, wherein the pockets on the PS of the fabric comprise full pockets and half pockets.

21. Fabric according to claim 20, wherein the full pockets are defined between alternate warp yarns and have at least three warp knuckles that define corners of the full pockets.

22. Fabric according to claim 20, wherein the half pockets are defined between adjacent warp yarns and have at least two warp knuckles that define corners of the half pockets.

23. Fabric according to claim 20, wherein at least ⅔ of the pockets are full pockets.

* * * * *